US005900353A

United States Patent [19]

Wildman

[11] Patent Number: 5,900,353

[45] **Date of Patent: * May 4, 1999**

[54] METHOD OF FORMING A PHOTOGRAPHIC COLOR IMAGE

[75] Inventor: Nigel Richard Wildman, Hertfordshire, United Kingdom

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/684,898

[22] Filed: Jul. 25, 1996

[30] Foreign Application Priority Data

Jul. 28, 1995 [GB] United Kingdom ..... 9515520

[51] Int. Cl.[6] ..... G03C 7/407

[52] U.S. Cl. ..... 430/373; 430/414; 430/943

[58] Field of Search ..... 430/373, 414, 430/943

[56] References Cited

U.S. PATENT DOCUMENTS

| | | | |
|---|---|---|---|
| 4,469,780 | 9/1984 | Hirai et al. | 430/373 |
| 5,324,624 | 6/1994 | Twist | 430/373 |
| 5,387,499 | 2/1995 | Earle et al. | 430/943 |
| 5,418,117 | 5/1995 | Marsden | 430/943 |

FOREIGN PATENT DOCUMENTS

| | | |
|---|---|---|
| 1 514 517 | 6/1974 | United Kingdom . |
| 2117914 | 1/1982 | United Kingdom . |

*Primary Examiner*—Hoa Van Le
*Attorney, Agent, or Firm*—J. Lanny Tucker

[57] ABSTRACT

Photographic materials are processed by color development and a peroxide amplifier solution. The color developer contains an alkali metal phosphate and has a pH of 11 to 12.

13 Claims, No Drawings

METHOD OF FORMING A PHOTOGRAPHIC COLOR IMAGE

FIELD OF THE INVENTION

This invention relates to forming a color image in a photographic material by the redox amplification process.

BACKGROUND OF THE INVENTION

Redox amplification processes have been described, for example in British Specification No. 1,268,126 and U.S. Pat. Nos. 3,748,138, 3,822,129 and 4,097,278. In one aspect of such processes, color materials are developed to produce a silver image (which may contain only small amounts of silver) and are then treated with a redox amplifying solution to form an amplified dye image.

The developer solution contains a color developing agent and the amplifier contains an oxidizing agent that will oxidize the color developing agent in the presence of the silver image that acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide.

Published PCT Application WO 92/07299 describes an example of such a process in which the photographic material is processed in separate color developer and amplification baths. The color developer solutions described therein have a pH of 10.3 and contain potassium carbonate as alkaline agent. On standing such a color developer darkens indicating that it is not very stable.

U.S. Pat. No. 4,084,969 describes a process in which the redox oxidant is a Co(III) complex. In Examples 1–3 the photographic material is processed in separate color developer and amplification baths, the color developer solutions having a pH of 10.0–10.1 and contain potassium carbonate as alkaline agent. In Example 4 the photographic element was exposed to X-rays using a fluorescent screen and the color developer solution is said to have a pH of 11.5. The alkaline agent was again potassium carbonate. No improvement in performance or stability is reported.

There is a constant desire to improve redox amplification processes that use a peroxide amplifier to provide better sensitometric results and more stable processing solutions.

SUMMARY OF THE INVENTION

According to the present invention there is provided a method of processing a color silver halide photographic material comprising:

color developing the material with a color developer solution, and contacting the developed material with a peroxide amplifier solution, wherein the color developer solution contains an alkali metal phosphate and has a pH in the range 11 to 12.

The use of a phosphate buffer and pH above 11 allow aim densities to be achieved in shorter process times than would be required with a carbonate buffered developers in the pH range of 10–11.

The appearance of the phosphate buffered developer on standing remains straw colored, whereas the equivalent carbonate buffered developer darkens considerably with age.

Precipitation of oxidized color developer occurs in the carbonate buffered developer before it does in the phosphate buffered developer.

The increase in the pH, when using a phosphate buffer allows more color developing agent to be dissolved in the developer without saturation occurring. This is particularly advantageous when using separate development and amplification baths as all the image forming developer has to be carried into the amplifier bath by the material being processed. The increased concentration of color developing agent in the developer bath allows more developing agent to be carried over.

The separate developer and amplifier baths are more stable than the corresponding stability of an equivalent combined developer/amplifier (DEVAMP) bath.

The process time can be reduced from 45 seconds for the DEVAMP process to a minimum time of 10 seconds develop and 5 seconds amplification without compromising developer stability.

The process is self limiting, i.e., the development stops in Dmax areas when all the developing agent is consumed or diffused out of the photographic material. With DEVAMPS the rate of amplification is at its maximum at the end of the development time hence separate develop and amplify systems are less sensitive to changes in development time. This leads to less process sensitivity.

The process is less sensitive to the concentration of hydrogen peroxide and above 5 ml/l is virtually insensitive to increasing the hydrogen peroxide concentration.

Shorter times in the amplifier bath result in lower Dmin and less susceptibility to build up of seasoning products in the amplifier bath as described in WO 92/07299 referred to above.

DETAILED DESCRIPTION OF THE INVENTION

The pH of the color developer may be above 11, for example in the range 11 to 12. Preferably the pH is in the range 11.3 to 11.7.

The phosphate used may be a sodium or potassium phosphate. It may be present in the color developer in amounts of 20 to 80 g/l, preferably 25 to 60 g/l, particularly 35 to 45 g/l (as potassium phosphate).

The color developer solution may also contain compounds that increase its stability, for example hydroxylamine, diethylhydroxylamine or a long chain compound that can adsorb to silver, e.g., dodecylamine or substituted dialkylhydroxylamines. Such long chain compounds can also be present in the amplifier solution.

The color developer may contain from 5 to 12 g/l of color developing agent, preferably from 7 to 10 g/l. The preferred color developing agents are p-phenylenediamines, for example:

4-amino N,N-diethylaniline hydrochloride, 4-amino-3-methyl-N,N-diethylaniline hydrochloride, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Especially preferred is

4-N-ethyl-N-(β-methanesulphonamidoethyl)-o-toluidine sesquisulphate that is known as CD3.

The peroxide amplification bath preferably contains 1 to 100 ml/l of 30%(w/w) hydrogen peroxide solution and optionally a buffer, for example, an alkali metal carbonate or phosphate. Its pH is preferably in the range 5 to 12, preferably 7 to 10. When using a phosphate buffer, the pH is preferably 10–12.

The developer and amplification steps may be followed by a bleach and/or fix step. If the silver coating weight is low enough either or both of these steps may be dispensed with.

A particular application of this technology is in the processing of silver chloride color paper, for example paper comprising at least 85 mole percent silver chloride, especially such paper with low silver levels, for example total silver levels below 130 mg/m$^2$, e.g., from 20 to 120 mg/m$^2$, preferably below 100 mg/m$^2$ and particularly in the range 20 to 100 mg/m$^2$. Within these total ranges the blue sensitive emulsion layer unit may comprise 20 to 60 mg/m$^2$, preferably 25 to 50 mg/m$^2$ with the remaining silver divided between the red and green-sensitive layer units, preferably more or less equally between the red and green-sensitive layer units.

The photographic elements processed in the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the elements processed in the present invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally positive (or reversal) image can be formed.

The present processing solutions may be applied to the photographic material by immersion, dipping, spraying, coating, wiping or application from a roller. Preferably the method of processing may be carried out by passing the material to be processed through a tank containing the processing solution that is recirculated through the tank at a rate of from 0.1 to 10 tank volumes per minute.

The preferred recirculation rate is from 0.5 to 8, especially from 1 to 5 and particular from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length×width of material) is less than 11 dm$^3$/m$^2$, preferably less than 3 dm$^3$/m$^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank (LVTT) systems are described in more detail in the following patent specifications:

U.S. Pat. No. 5,436,118, U.S. Pat. No. 5,294,956, EP 0,559,027,

U.S. Pat. No. 5,179,404, EP 0,559,025, U.S. Pat. No. 5,270,762,

EP 0,559,026, WO 92/10790, WO 92/17819,

WO 93/04404, WO 92/17370, WO 91/19226,

WO 91/12567, WO 92/07302, Wo 93/00612,

WO 92/07301, and WO 92/09932.

The following Examples are included for a better understanding of the invention.

EXAMPLE 1

A multilayer color photographic paper coating containing silver chloride emulsions coated at a total silver level of 58 mg/m$^2$ was exposed to a 0–3 Log E, 0.15 increment step wedge.

Exposed strips were processed in the Split Dev 1 formulation, the strips were soaked in the developer for a series of times from 10 to 30 seconds, excess developer was squeegee'd from the surface and the strips transferred into the amplifier bath for 10 seconds. These strips were then fixed for 45 seconds in dilute C-41 fixer (100 ml/l) and washed. The same procedure was conducted with the Split Dev 2 formulation. The composition of the two developers is shown below:

| | Split Dev 1 formula | Split Dev 2 formula |
|---|---|---|
| Developer | | |
| 1-hydroxyethylidene-1,1'-diphosphonic acid | 0.6 g/l | 0.6 g/l |
| Pentetic acid | 0.81 g/l | 0.81 g/l |
| $K_2HPO_4.3H_2O$ | 40 g/l | — |
| $K_2CO_3$ | — | 24.18 g/l |
| KBr | 1 mg/l | 1 mg/l |
| KCl | 1 g/l | 1 g/l |
| Diethylhydroxylamine | 3.0 ml/l | 3.0 ml/l |
| 4-N-ethyl-N-(β-methane-sulphonamidoethyl)-o-toluidine sesquisulphate | 10 g/l | 10 g/l |
| 50% w/w KOH to pH (@ 25 °C. | 11.40 | 10.0 |
| Time | 20 seconds | 20 seconds |
| Temperature | 35 °C. | 35 °C. |
| Amplifier | | |
| $H_2O_2$ | 6 ml/l (30% w/w) | |

| Dev time (s) | Amp time (s) | Split Dev Proc | Dmax Red | Dmax Green | Dmax Blue | Dmin Red | Dmin Green | Dmin Blue |
|---|---|---|---|---|---|---|---|---|
| 10 | 10 | 1 | 2.25 | 1.89 | 1.77 | 0.11 | 0.11 | 0.10 |
| 10 | 10 | 2 | 1.81 | 1.42 | 1.33 | 0.10 | 0.10 | 0.08 |
| 15 | 10 | 1 | 2.60 | 2.02 | 2.09 | 0.12 | 0.12 | 0.11 |
| 15 | 10 | 2 | 2.05 | 1.59 | 1.63 | 0.10 | 0.11 | 0.09 |
| 20 | 10 | 1 | 2.66 | 2.15 | 2.27 | 0.13 | 0.12 | 0.11 |
| 20 | 10 | 2 | 2.07 | 1.66 | 1.82 | 0.10 | 0.11 | 0.09 |
| 25 | 10 | 1 | 2.66 | 2.23 | 2.27 | 0.13 | 0.13 | 0.12 |
| 25 | 10 | 2 | 2.26 | 1.81 | 1.83 | 0.11 | 0.11 | 0.09 |
| 30 | 10 | 1 | 2.72 | 2.25 | 2.37 | 0.14 | 0.13 | 0.13 |
| 30 | 10 | 2 | 2.33 | 1.86 | 1.93 | 0.12 | 0.12 | 0.10 |
| 35 | 10 | 1 | 2.66 | 2.20 | 2.31 | 0.16 | 0.15 | 0.14 |
| 35 | 10 | 2 | 2.26 | 1.80 | 1.97 | 0.12 | 0.11 | 0.10 |

It can be seen that the densities produced by Split Dev 1 (pH 11.4) are greater than those from Split Dev 2 (pH 10.0) indicating that a shorter process time can be used with Split Dev 1 to give the same density.

On standing for 24 hours Split Dev 1 was a pale straw color while Split Dev 2 was a dark purple-brown typical of oxidized color developing agent.

EXAMPLE 2

In this example the amplifying agent concentration was increased at a constant development time of 20 seconds. The same low silver coating was immersed in Split Dev 1 for 20 seconds, squeegee'd and transferred to the amplification bath for 10 seconds. The experiment was repeated with more concentrated amplifiers. The neutral status A densitometry is shown below.

| Hydrogen peroxide conc in amplifier (ml/l 30% w/w) | Dmax Red | Dmax Green | Dmax Blue | Dmin Red | Dmin Green | Dmin Blue |
|---|---|---|---|---|---|---|
| 2 | 2.00 | 1.67 | 2.02 | 0.10 | 0.10 | 0.09 |
| 3 | 2.38 | 1.94 | 2.16 | 0.11 | 0.11 | 0.10 |
| 4 | 2.46 | 2.02 | 2.11 | 0.11 | 0.11 | 0.10 |
| 5 | 2.38 | 1.96 | 2.05 | 0.11 | 0.11 | 0.10 |
| 6 | 2.34 | 2.21 | 2.21 | 0.11 | 0.11 | 0.10 |
| 7 | 2.46 | 2.01 | 2.06 | 0.12 | 0.12 | 0.11 |
| 20 | 2.31 | 2.08 | 1.97 | 0.11 | 0.11 | 0.10 |

From the data it can be seen that 6.0 ml/l 30% w/w is the optimum hydrogen peroxide concentration for the best Dmax values. The process can tolerate higher concentrations of hydrogen peroxide without appreciable loss in Dmax.

The invention has been described in detail with particular reference to preferred embodiments thereof, but it will be understood that variations and modifications can be effected within the spirit and scope of the invention.

I claim:

1. A method of processing a color silver halide photographic paper comprising only silver halide emulsions comprising at least 85 mol % silver chloride:

color developing said color paper with a color developer solution containing from 5 to 12 g/l of a color developing agent, and separately contacting said developed color paper with a peroxide amplifier solution containing 1 to 100 ml/l of a 30% w/w hydrogen peroxide, wherein said color developer solution contains, as a buffer, an alkali metal phosphate in an amount of 20 to 80 g/l and has a pH in the range of from 11 to 12, and wherein said color developing and contacting steps are together carried out within a total of from 15 to 40 seconds.

2. The method of claim 1 wherein said peroxide amplifier solution has a pH in the range 5 to 12.

3. The method of claim 1 wherein said peroxide amplifier solution contains an alkali metal phosphate and has a pH in the range 10–12.

4. The method of claim 3 in which the phosphate has the formula $K_2HPO_4.3H_2O$ or $Na_2HPO_4.3H_2O$.

5. The method of claim 1 wherein the pH of said color developer solution is from 11.3 to 11.7.

6. The method of claim 1 wherein the total silver halide coating weight in said color paper is in the range of from 20 to 130 mg/m$^2$.

7. The method of claim 1 carried out by passing said color paper through a tank containing each processing solution that is being recirculated at a rate of from 0.1 to 10 tank volumes per minute.

8. The method of claim 7 wherein the ratio of tank volume to maximum area of color paper accommodatable therein is less than 11 dm$^3$/m$^2$.

9. The method of claim 6 wherein said color paper has a blue sensitive emulsion layer comprising from 20 to 60 mg silver per $m^2$.

10. The method of claim 7 wherein the ratio of tank volume to maximum area of color paper accommodatable therein is less than 3 $dm^3/m^2$.

11. The method of claim 1 wherein said color developing agent is present in an amount of from 7 to 10 g/l.

12. The method of claim 1 wherein said phosphate in said color developer solution is present in an amount of from 25 to 60 g/l.

13. The method of claim 1 wherein said phosphate in said color developer solution is present in an amount of from 35 to 45 g/l.

* * * * *